US006584299B2

(12) United States Patent
Nomura

(10) Patent No.: US 6,584,299 B2
(45) Date of Patent: Jun. 24, 2003

(54) IMAGE FORMING APPARATUS

(75) Inventor: Susumu Nomura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/964,652

(22) Filed: Sep. 28, 2001

(65) Prior Publication Data

US 2003/0063937 A1 Apr. 3, 2003

(51) Int. Cl.[7] ..... G03G 15/00
(52) U.S. Cl. ..... 399/405; 399/92; 399/125
(58) Field of Search ..... 399/92, 94, 122, 399/125, 397, 400, 405, 381, 124

(56) References Cited

U.S. PATENT DOCUMENTS 5,168,286 A * 12/1992 Okauchi et al. ..... 399/2 X
5,212,528 A * 5/1993 Matsuda et al. ..... 399/330 X
5,291,256 A * 3/1994 Kitajima et al. ..... 399/122
5,337,134 A * 8/1994 Sato et al. ..... 399/397 X
5,897,244 A * 4/1999 Miyazaki et al. ..... 399/122
6,108,514 A * 8/2000 Nakayama et al. ..... 399/400
6,304,742 B1 * 10/2001 Nunes et al. ..... 399/405 X

FOREIGN PATENT DOCUMENTS

JP 9-114153 5/1994

* cited by examiner

*Primary Examiner*—Sandra Brase
(74) *Attorney, Agent, or Firm*—Foley & Lardner

(57) ABSTRACT

An image forming apparatus includes a vertical transfer path and a horizontal transfer path, which is continuous to the vertical transfer path. A fixing roller is brought into contact with the vertical transfer path and heats and melts toner of the toner image. A pressurizing roller opposite to the fixing roller is brought into contact with another surface on the vertical transfer path and pressurizes the toner image. A paper discharge driving roller provided at an end of the horizontal transfer path, substantially horizontally discharges the paper sheet with the toner image fixed thereon. A tray receives the paper sheet, and a paper transfer guide guides the paper sheet to be transferred along the vertical and the horizontal transfer path. A paper discharge guide roller rotates following the motion of the paper sheet to be transferred.

15 Claims, 7 Drawing Sheets

IMAGE FORMING APPARATUS

BACKGROUND OF THE INVENTION

The present invention relates to an image forming apparatus, such as an electrophotographic copying machine or a laser printer, and particularly to an improvement of a paper discharging mechanism of a fixing unit for fixing a toner image on a paper sheet.

In a conventional apparatus, as shown in FIG. 1, a paper sheet P is supplied through a vertical transfer path 103*a* from a developing unit (not shown) located below, and passes through a nip portion between a fixing roller 102 and a pressurizing roller 104, and further through a paper transfer guide 106 located above. The direction of the transfer is converted from the vertical to the horizontal by the paper transfer guide 106. Then, the paper sheet P is guided along a horizontal transfer path 103*b* to paper discharge driving rollers 110, and sent out on a tray (not shown) by the paper discharge driving rollers 110.

As shown in FIG. 2, the paper transfer guide 106 comprises a quarter cylinder having a curved surface in accordance with the transfer trail of the paper sheet P. A plurality of ribs 108 are attached on the circumferential surface of the quarter cylinder at regular pitch.

Normally, the fixing roller 102 and the paper discharge driving rollers 110 are drive-controlled, such that the circumferential velocity of the paper discharge driving rollers 110 is slightly higher than that of the fixing roller 102, in order to avoid jamming of the paper sheet P. Therefore, the paper sheet P may be rubbed against a diagonally shaded portion 108*a* of the ribs 108 shown in FIG. 1, in which case the toner image will be disordered.

Further, if a large amount of toner is fixed on the paper sheet P, the surplus toner is liable to adhere to and accumulate on the surface of the paper transfer guide 106 or the ribs 108. The adhering and accumulating toner may be adhered to a succeeding paper sheet P, and stain this paper sheet P.

In addition, since the distance from the fixing roller 102 to the paper discharge driving rollers 110 is short, the paper sheet P heated by the fixing roller 102 is discharged onto the tray through the paper discharge driving rollers 110 in a hot state. Therefore, when a user immediately picks up the paper sheet P from the tray, the user may feel pain due to the heat.

Furthermore, in the conventional apparatus, during a double-sided copying operation, the paper sheet P that has been discharged from the apparatus is returned to the inside of the apparatus. Therefore, the apparatus has the problem that the temperature in the apparatus rises due to the heat of the paper sheet P.

BRIEF SUMMARY OF THE INVENTION

An object of the present invention is to provide an image forming apparatus that does not disorder a toner image or cause adhesion of toner on members in the paper transfer path and that can lower the temperature of the discharged paper sheet.

An image forming apparatus of the present invention comprises: a vertical transfer path through which a paper sheet having a toner image is transferred upward from below; a horizontal transfer path which is continuous to the vertical transfer path and through which the paper sheet is transferred in a substantially horizontal direction; a fixing roller which is brought into contact with one surface of the paper sheet on the vertical transfer path and which heats and melts toner of the toner image; a pressurizing roller which is opposite to the fixing roller and which is brought into contact with another surface of the paper sheet on the vertical transfer path and pressurizes the toner image in association with the fixing roller; a paper discharge driving roller which is provided at an end of the horizontal transfer path and which substantially horizontally discharges the paper sheet with the toner image fixed thereon; a tray which receives the paper sheet discharged from the paper sheet discharge roller; a paper transfer guide which is provided between the fixing roller and the paper discharge driving roller and which guides the paper sheet to be transferred along the vertical transfer path and the horizontal transfer path; and a paper discharge guide roller which is provided at a position between the vertical transfer path and the horizontal transfer path where a transfer direction of the paper sheet is changed from vertical to horizontal, and which rotates following motion of the paper sheet to be transferred, which is made of a high-conductivity material and which has a structure of a good heat radiating characteristic.

It is preferable that the paper discharge guide roller be covered with an antistatic resin film on its circumferential surface. Polytetrafluoroethylene is suitable for such a resin.

According to this embodiment, since the paper discharge guide roller is covered with a fluorinated ethylene resin-based film on its circumferential surface, toner does not adhere to the paper discharge guide roller. Particularly, even if the surface of a paper sheet, which is brought into close contact with the paper discharge guide roller, is a printed surface and a great amount of toner is fixed to the paper sheet, the toner will not adhere to the paper discharge guide roller.

Since the film covering the paper discharge guide roller may easily be charged, it is preferable that the film be conductive.

Polyacethylene, poly-p-phenylene and polypyrrole may be used as a conductive film. Static electricity charged on the paper sheet is discharged through the conductive film, so that electric coupling of the toner is released.

Preferably, the paper discharge guide roller comprises a metal cylinder having a hollow portion extending therethrough in an axial direction and has a plurality of inner ribs in the hollow portion. Straight blades, spiral blades or screw blades can be used as the inner ribs. In the case of spiral blades or screw blades, it is preferable that the blades be inclined 10° to 45° with respect to the axis of the paper discharge guide roller. When the paper discharge guide roller rotates following the paper sheet, the inner ribs shaped as the spiral blades or screw blades rotate to expel the heat from the hollow portion of the paper discharge guide roller, so that the paper discharge guide roller is cooled.

The hollow portion of the paper discharge guide roller may be exhausted by an electric fan.

Preferably, the image forming apparatus further comprises: an upper cover which is freely opened and closed to allow inspection of the paper discharge guide roller, the paper discharge driving roller, the paper transfer guide, the vertical transfer path and the horizontal transfer path, and which covers from above the paper discharge guide roller, the paper discharge driving roller, the paper transfer guide, the vertical transfer path and the horizontal transfer path when it is closed; a protective cover which is provided in non-contact with the paper discharge guide roller and made of material of a low-thermal-conductivity and which covers a circumferential surface of the paper discharge guide roller facing the horizontal transfer path, when the upper cover is opened; and a link mechanism which links to the protective cover and the upper cover such that the protective cover interlocks with the upper cover.

When the upper cover is opened, the circumferential surface of the paper discharge guide roller, which exposes in the horizontal path, is covered by the protective cover. Therefore, the operator can safely work without a possibility of a burn.

It is preferable that the image forming apparatus further comprise a peeling claw mechanism to peel the paper sheet from the paper discharge guide roller. Since it is ensured that the paper sheet is removed from the paper discharge guide roller by the peeling claw mechanism, paper-jamming trouble does not occur.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Various preferred embodiments of the present invention will be described below with reference to the accompanying drawings.

(First Embodiment)

Figure 1:
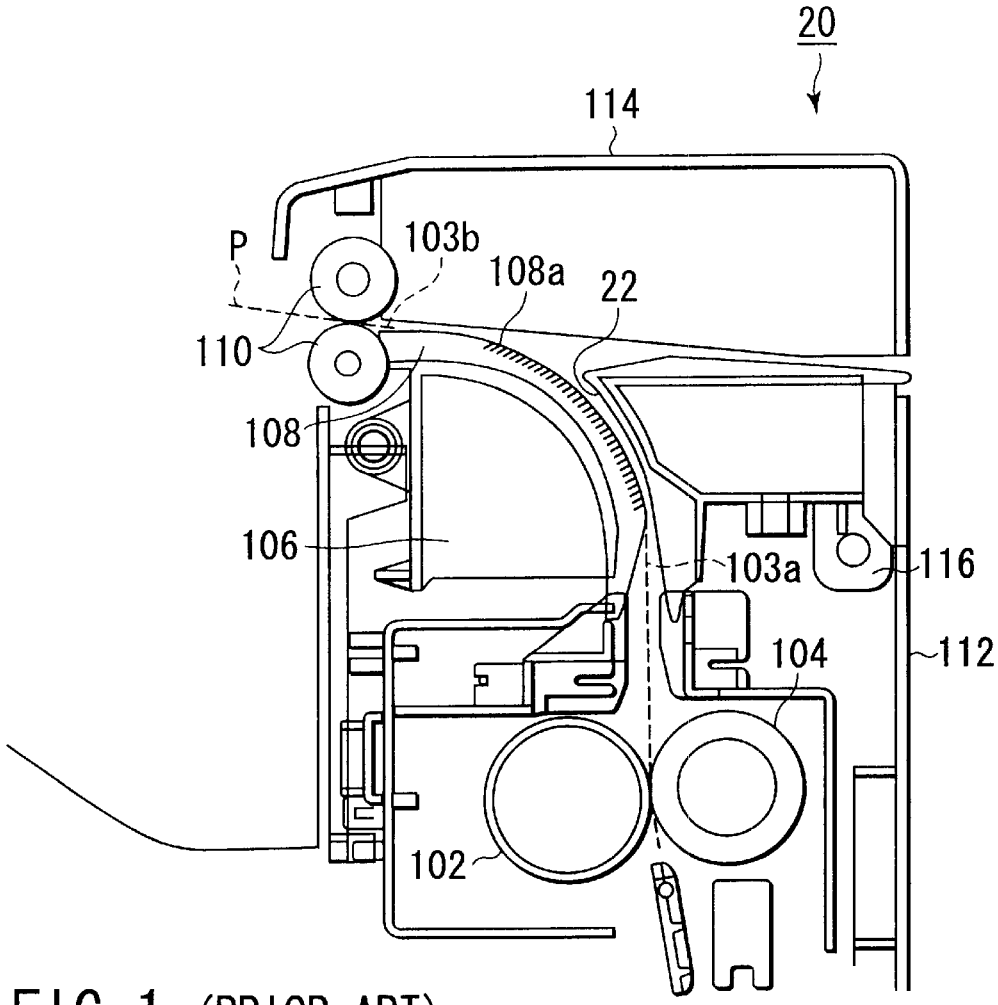
FIG. 1 (PRIOR ART)
FIG. 1 is an opened-up cross-sectional view showing the interior of a fixing portion of the conventional apparatus.
Figure 2:
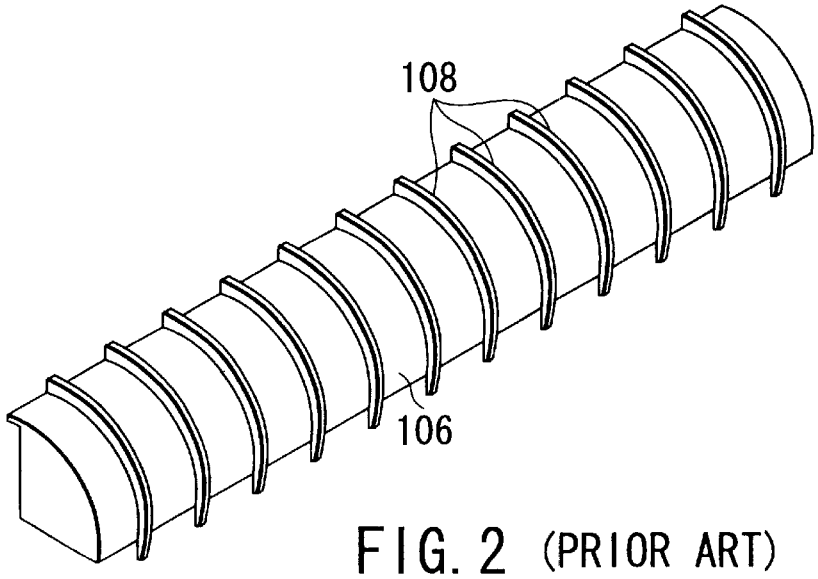
FIG. 2 (PRIOR ART)
FIG. 2 is an exploded perspective view showing a paper discharge guide of the conventional apparatus.
Figure 3:
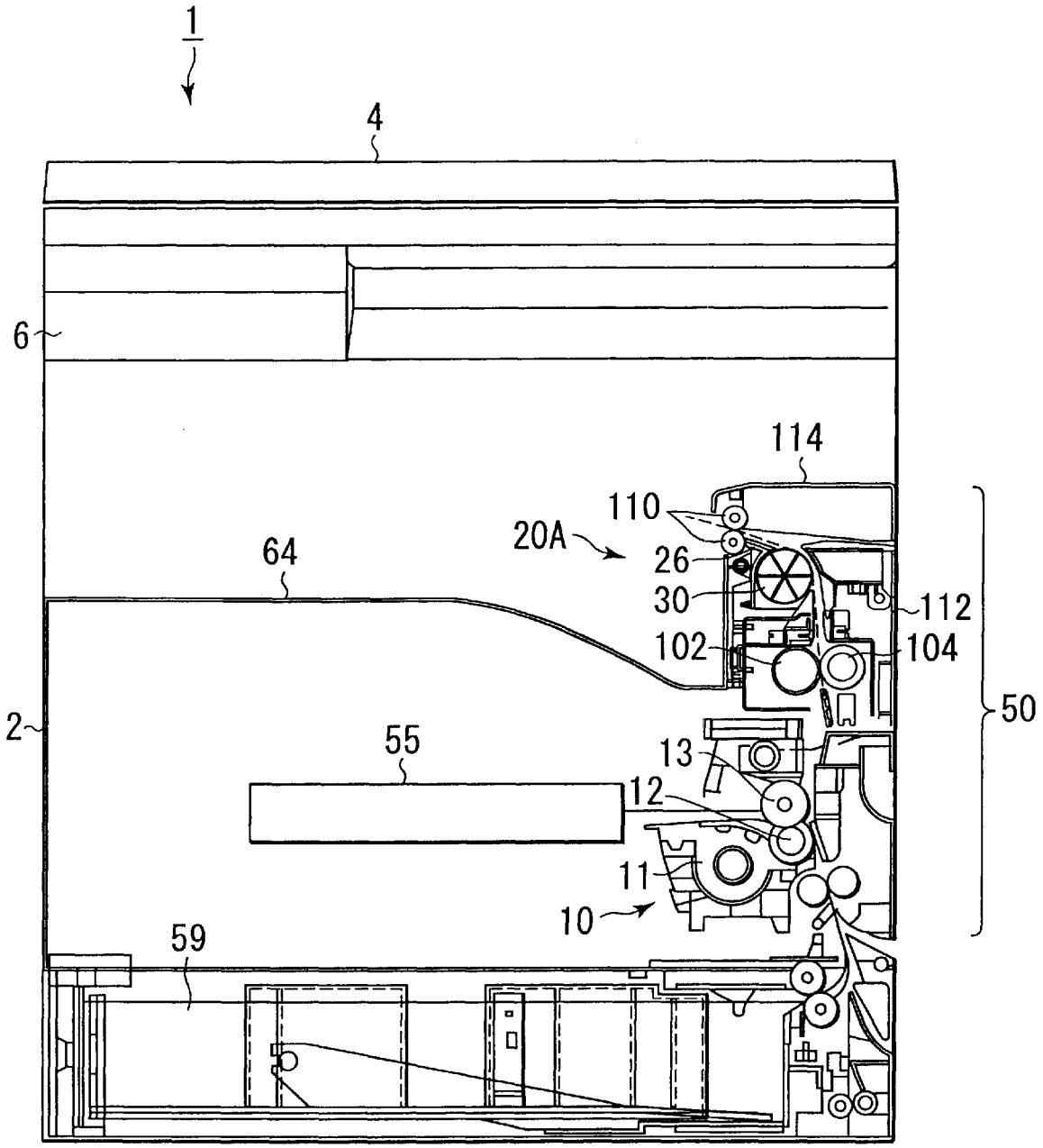
FIG. 3 is a partially opened-up cross-sectional view showing the outline of an image forming apparatus according to a first embodiment of the present invention.

As shown in FIG. 3, a digital copying apparatus (image forming apparatus) 1 comprises an image forming section 50, an image reading device (scanner) 6, a paper feeding device 59 and a paper discharge tray 64. The image forming section 50 has a developing device 10 and a fixing device 20A. It forms an image corresponding to an image signal supplied from the scanner 6 or an external device, and fixes it on a paper sheet P.

The scanner 6 captures an object image as the variations of light and shade and performs optoelectronic conversion, thereby forming an image signal. The paper feeding device 59 includes a pickup roller, etc. for supplying the paper sheet P to the image forming section 50. The paper discharge tray 64 receives the paper sheet P discharged from the fixing device 20A.

The image forming section 50 further comprises an exposure device 55 and a photosensitive drum 13 in addition to the developing device 10 and the fixing device 20A. The exposure device 55 includes a light source (not shown), which radiates a laser beam corresponding to the image information supplied from the scanner 6 or the external device. The photosensitive drum 13 holds an image corresponding to the laser beam from the exposure device 55. The developing device 10 includes a developing roller 12 for supplying toner to an electrostatic latent image formed on the photosensitive drum 13 and an agitator 11 for supplying the toner to the developing roller 12.

The fixing device 20A of the first embodiment will now be described in detail with reference to FIGS. 4 to 6.

The fixing device 20A heats and melts, by means of the fixing roller 102, the toner image that is electrostatically attracted to the paper sheet P, and pressurizes it by means of a pressurizing roller 104, thereby fixing it on the paper sheet P. The fixing roller 102 incorporates an induction heater (not shown) and it is supported by a rotary drive shaft not shown. The pressurizing roller 104 is coupled to a pressurizing drive mechanism (not shown). When the pressurizing roller 104 is pressed against the fixing roller 102, a so-called nip portion is formed therebetween. In the state where the nip portion is formed, when the paper sheet P is passed between the rollers 102 and 104, the toner is melted under the heat and pressure, so that the toner image is fixed on the paper sheet P.

Figure 4:
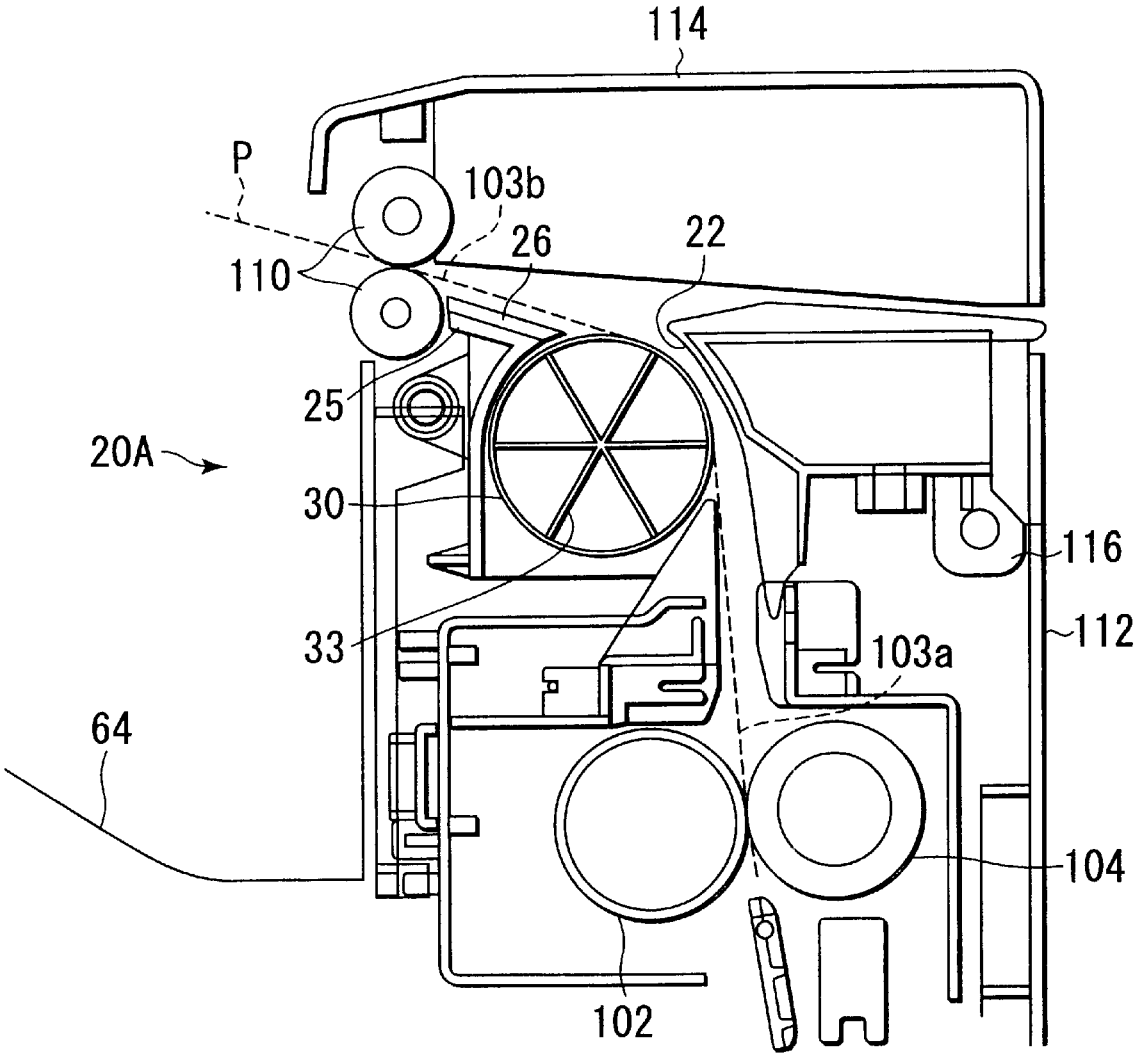
FIG. 4 is an opened-up cross-sectional view showing the interior of a fixing portion of the image forming apparatus according to the first embodiment.

As shown in FIG. 4, the fixing device 20A is provided along paper transfer paths 103*a* and 103*b* extending from the fixing roller 102 to the paper discharge driving rollers 110. The fixing device 20A has first and second paper transfer guides 22 and 25 and a paper discharge guide roller 30 to guide the paper sheet P to the paper discharge driving rollers 110 so that the paper sheet P does not deviate from the paper transfer paths 103*a* and 103*b*.

The paper discharge guide roller 30 is located in a position at which the direction of transfer of the paper sheet P is changed from the vertical to the horizontal, i.e., where the vertical transfer path 103*a* is switched to the horizontal transfer path 103*b*.

The first paper transfer guide 22 is provided along the vertical transfer path 103*a*. It faces the paper discharge guide roller 30 such that a suitable gap is formed between itself and the paper discharge guide roller 30. Further, the first paper transfer guide 22 is curved in accordance with the shape of the circumferential surface of the guide roller 30 to direct the leading end of the paper sheet P toward the horizontal transfer path 103*b*.

The second paper transfer guide 25 is provided along the vertical transfer path 103*b*. It is positioned between the paper discharge guide roller 30 and the paper discharge driving rollers 110. A plurality of short ribs 26, for guiding the paper sheet P slightly upward from the horizontal, are mounted on the upper surface of the guide 25. These ribs 26 are to reduce the transfer resistance of the paper sheet P.

Figure 9:
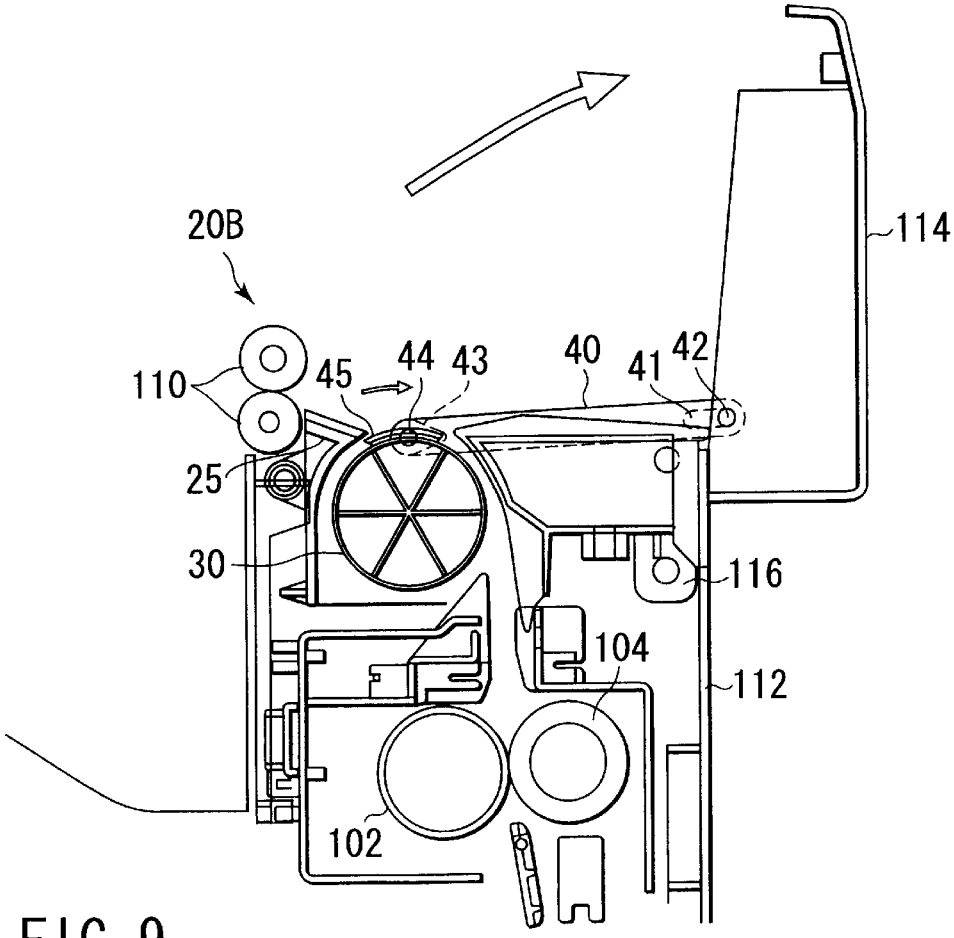
FIG. 9 is an opened-up cross-sectional view showing the interior of a fixing apparatus of an image forming apparatus according to a third embodiment of the present invention, in which the cover is opened.

An upper cover 114 is provided on top of the fixing device 20A so as to cover the paper discharge guide roller 30, the paper discharge driving rollers 110, and the paper transfer guides 22 and 25. The upper cover 114 is mounted on an exterior frame 112 via a hinge 116. It is rotated about the hinge 116 and opened as shown in FIG. 9. Since the upper portion of the fixing device 20A is exposed when the upper cover 114 is opened, a jammed paper sheet P can be removed from between the rollers 30, 102, 104 and 110 in case paper jamming occurs.

Figure 5:
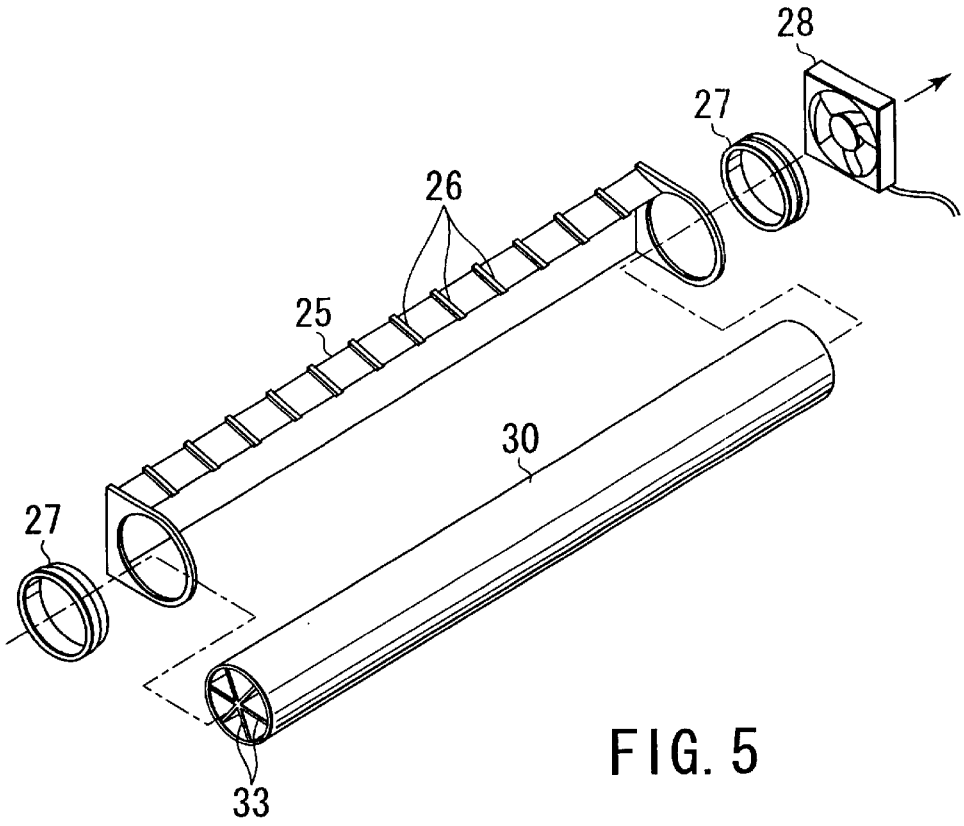
FIG. 5 is an exploded perspective view showing a paper discharge guide roller according to the first embodiment.

As shown in FIG. 5, the paper discharge guide roller 30 has a cylindrical shape including a hollow portion extending through the axial direction. It is rotatably supported by the paper transfer guide 25 via a pair of bearings 27. Since the paper discharge guide roller 30 is rotated following the movement of the paper sheet P that is being transferred, the paper sheet P and the guide roller 30 do not rub against each other. Therefore, the toner image is not disordered, nor does the toner adhere to the surface of the roller 30.

The paper discharge guide roller 30 has a hollow cylindrical shape, which is reinforced by inner ribs 33 shaped as straight blades. Both ends of the roller 30 are open. An electric fan 28 is arranged near a back end opening of the paper discharge guide roller 30 coaxially with respect to the roller 30, so that the hollow portion of the roller 30 can be exhausted. When the paper discharge guide roller 30 is brought into contact with the paper sheet P, the temperature thereof rises due to the heat transferred from the paper sheet P. However, since the fan 28 positively expels the heat from the interior of the roller 30, the temperature is lowered.

Figure 6:
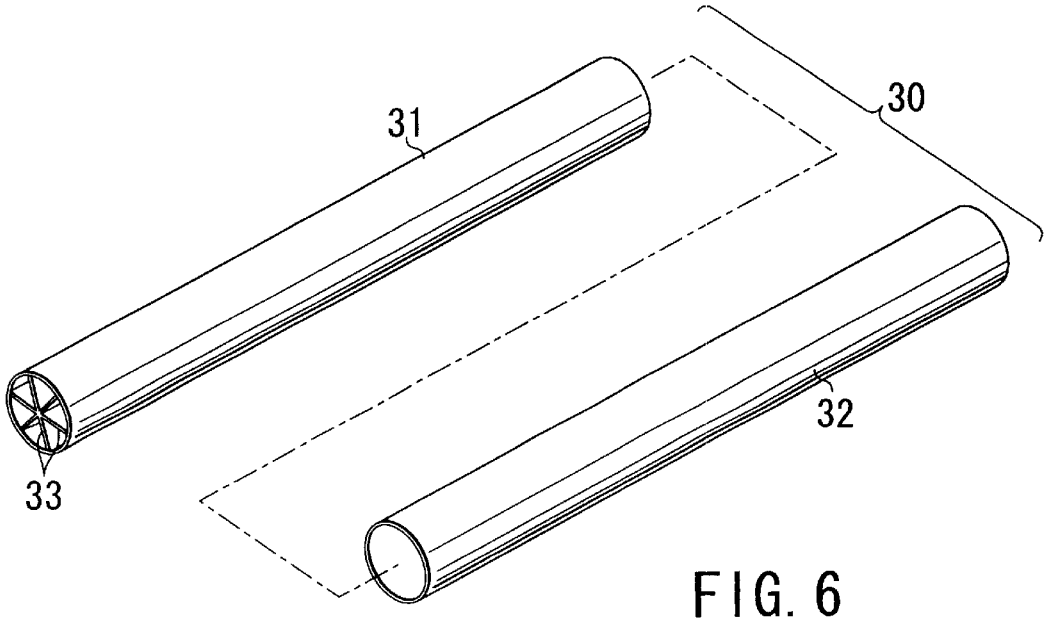
FIG. 6 is an exploded perspective view showing the paper discharge guide roller and an exterior film tube according to the first embodiment.

As shown in FIG. 6, the paper discharge guide roller 30 comprises a roller main body 31 covered with an antistatic film 32. The roller main body 31 is formed of a high-thermal-conductivity material, for example, aluminum or an aluminum alloy. Further, the inner ribs 33 are attached in the hollow portion of the roller main body 31. Since the surface area of the hollow portion (exhaust path) in the guide roller is increased due to the inner ribs 33, the cooling effect of the roller 30 is improved. It is preferable that the size of the guide roller be 300–320 mm in length and 20–40 mm in outer diameter.

The antistatic film 32 is 0.1–0.2 mm thick and made of resin that suppresses the build-up of static electricity, for example, polytetrafluoroethylene (Teflon, a trademark of Du Pont: fluorinated ethylene resin). The antistatic film 32 prevents the toner from being adhered to the guide roller 30.

An operation of the above image forming apparatus 1 will now be described.

When an image signal is transmitted from the scanner 6, a laser beam (not shown), which has been intensity-modulated in accordance with the image signal, is radiated from the exposure device 55 to the photosensitive drum 13. As a result, an electrostatic latent image corresponding to the image to be copied (output) is formed on the photosensitive drum 13. The electrostatic latent image is developed by the developing roller 12 and converted to a toner image on the photosensitive drum 13. The toner image is transferred to the paper sheet P supplied from the paper feeding device 59 at a transfer position opposite to a transfer device, to which no reference numeral is assigned.

In the paper feeding device 59, paper sheets P are picked up by the pickup roller one by one from a cassette. The paper sheet P is transferred toward the photosensitive drum 13, aligned with the photosensitive drum 13 by an aligning roller. Then, it is transferred to the transfer position in exact timing with the toner image on the photosensitive drum 13. The paper sheet P is further transferred vertically from the photosensitive drum 13 along the transfer path 103 toward the fixing device 20A.

In the fixing device 20A, the fixing roller 102 is heated to a predetermined temperature (for example, 200° C.) by the heater. The pressurizing roller 104 is pressed against the fixing roller 102 by the pressurizing drive mechanism, thereby forming a nip portion between the rollers 102 and 104. In the state where the nip portion is formed, the paper sheet P is passed between the rollers 102 and 104, so that the toner image is fixed on the paper sheet P.

Further, the paper sheet P passes the first transfer guide 22, the paper discharge guide roller 30, the second transfer guide 25 and the paper discharge driving rollers 110 in this order, and is discharged on the tray 64. During this time, the transfer direction of the paper sheet P is converted from the vertical to the horizontal by the first transfer guide 22 and the paper discharge guide roller 30. The circumferential velocity of the paper discharge driving rollers 110 is set slightly higher than that of the fixing roller 102. Therefore, during this time, a slight tension is exerted on the paper sheet P, with the result that the paper sheet P is pressed against the guide roller 30.

However, since the guide roller 30 is rotated freely following the paper sheet P, the paper sheet P is prevented from being rubbed against the guide roller 30. Consequently, the toner image is not disordered. Moreover, since the guide roller 30 is covered with the antistatic film 32, the toner does not electro-statically adhere to the surface of the roller 30. Furthermore, since the interior of the guide roller 30 is exhausted by the fan 28, the guide roller 30 is positively cooled, so that the roller 30 and the paper sheet P is prevented from overheating.

EXAMPLE

An example will be described in detail, in which an original image is actually copied on a paper sheet P by means of the fixing device 20A of this embodiment.

(1) Conditions of Copying

The paper size: A4

The paper feed direction: sideways

The paper transfer velocity: 20 sheets/min

Fixing temperature: 200° C.

The quantity of air supplied by the fan 28: 0.1 $m^3$/min

The wind pressure of the fan 28: 17.5 mmAq

The outer diameter of the paper discharge guide roller 30: ϕ30 mm

The thickness of the paper discharge guide roller 30: 1 mm

The material of the paper discharge guide roller 30: aluminum

The number of the inner ribs (fins) 33: three (2) Results

When an image is copied on the paper sheet P under the above conditions (1), the temperature of the discharged paper from the device 20A of this embodiment was lowered about 15° C. as compared to that discharged from the conventional device. In this description, "the temperature of the discharged paper" means the temperature of the paper sheet P measured immediately after it passed the paper discharge driving rollers 110.

When an image is copied on both sides of the paper sheet P under the above conditions (1), the surface temperature of the photosensitive drum 13 was lowered about 5° C. as compared to that of the conventional device.

(Second Embodiment)

Figure 7:
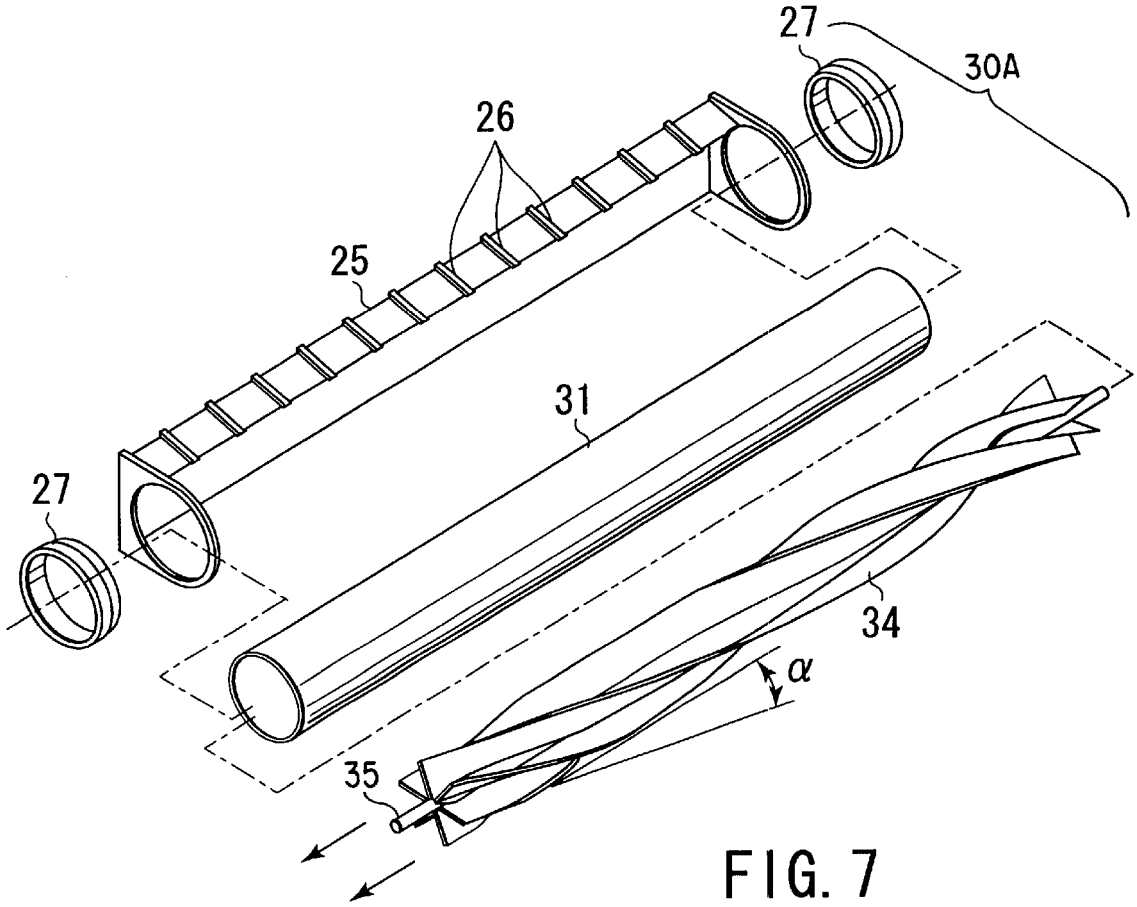
FIG. 7 is an exploded perspective view showing a paper discharge guide roller according to a second embodiment.

A second embodiment will now be described with reference to FIG. 7.

In a paper discharge guide roller 30A of the second embodiment, inner blade ribs 34 shaped as a spiral or screw is inserted in a hollow portion of a roller main body 31. The paper discharge guide roller 30A is rotatably supported to a guide 25 via a pair of bearings 27. The inner blade ribs 34 are mounted on a suitable position of the guide 25 via a shaft 35. Therefore, the guide roller 30A drags along with the passage of the paper sheet P, thereby rotating the inner blade ribs 34 together with the roller 30A. As a result, heated air is discharged outside from the hollow portion of the roller 30A.

Thus, the inner blade ribs 34 have the same effect as that of the fan 28 of the first embodiment described above. It was confirmed that when the angle $\alpha$ of twist of the inner blade ribs 34 was between or equal to 10° and 45°, the heated air was efficiently expelled from the hollow portion of the roller 30A. Moreover, when the angle $\alpha$ of twist of the inner blade ribs 34 fell within a range between 20° and 30°, the roller 30A was cooled most efficiently.

The inner blade ribs 34 of this embodiment are more advantageous than the electric fan 28 of the first embodiment in terms of device cost and energy cost.

(Third Embodiment)

A third embodiment will be described with reference to FIGS. 8 and 9.

When a paper jamming trouble occurs, the operator removes the jammed paper sheet from the transfer paths 103*a* and 103*b*. During this time, if the operator touches the paper discharge guide roller 30 heated to a high temperature, there is the possibility of a burn on a hand. In particular, just after double-sided copying is performed repeatedly, the paper discharge guide roller 30 is heated to about 100° C. This situation is dangerous.

Accordingly, in a fixing device 20B of the third embodiment, when the upper cover 114 is opened as shown in FIG. 9, a protective cover 45 slides so that an upper exposed surface of the paper discharge guide roller 30 is covered with the protective cover 45. The protective cover 45 is provided along the paper discharge guide roller 30 from end to end in the longitudinal direction of the guide roller 30. The protective cover 45 has a shape corresponding to a circumferential surface of the paper discharge guide roller 30 and a size covering about ⅙ of the circumferential surface of the paper discharge guide roller 30.

The protective cover 45 is made of a ceramic material or a plastic material of a low-thermal-conductivity, and provided in non-contact with the paper discharge guide roller 30. Therefore, even if the paper discharge guide roller 30 is at a high temperature, the protective cover 45 is not thermally influenced and the temperature thereof is kept substantially at room temperature.

Figure 8:
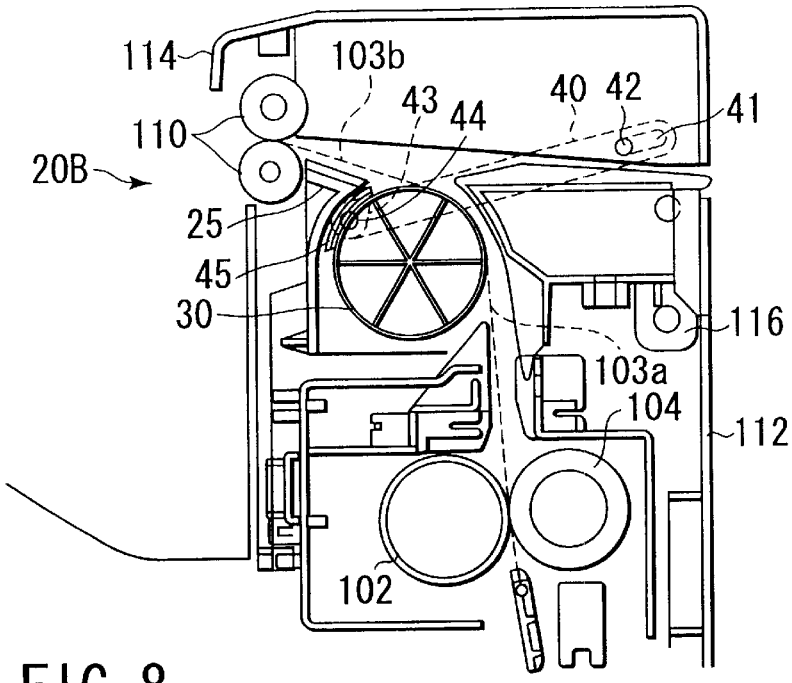
FIG. 8 is an opened-up cross-sectional view showing the interior of a fixing apparatus of an image forming apparatus according to a third embodiment of the present invention, in which the cover is closed.

As shown in FIG. 8, in the state where the upper cover 114 is closed, the protective cover 45 is retreated at a lower position of a paper transfer guide 25 (retreat position). When the protective cover 45 is located at the retreat position, the paper sheet P can pass along the transfer path 103 while it is in contact with the paper discharge guide roller 30.

The protective cover 45 is movably supported by a slide guide (not shown) of the frame 112 and linked to the upper cover 114 via a link mechanism. The slide guide is mounted on each of the side walls of the frame 112 (the wall surfaces perpendicular to the shaft of the paper discharge guide roller 30), thereby supporting and guiding both end portions of the protective cover 45.

The link mechanism includes a pair of arms 40 and a pair of swing pieces 43. A long hole 41 is formed in one end side of the arm 40 (the upper cover 114 side). A rod 42 attached to the cover 114 is inserted in the long hole 41. The swing piece 43 is attached to the other end side of the arm 40 (the protective cover 45 side) via a shaft 44. The swing piece 43 swings around the shaft 44 together with the protective cover 45.

As shown in FIG. 9, when the upper cover 114 is opened, the arm 40 moves to the right of the drawing, and the protective cover 45 slides along the slide guide while swinging around the shaft 44 together with the swing piece 43. As a result, the protective cover 45 is located at a position (protect position) where the upper portion of the paper discharge guide roller 30 is covered. Thus, the hands of the operator are prevented from directly touching the guide roller 30.

On the other hand, when the upper cover 114 is closed, as shown in FIG. 8, the arm 40 is moved to the left of the drawing, and the protective cover 45 slides along the slide guide while swinging around the shaft 44 together with the swing piece 43. As a result, the protective cover 45 is returned from the protect position to the retreat position.

According to this embodiment, the operator can safely removes a jammed paper sheet from the transfer path without a possibility of a burn on a hand.

(Fourth Embodiment)

A fourth embodiment will now be described with reference to FIGS. 10 to 12.

If the leading end of a paper sheet P is curled or the leading end of the paper sheet P is electro-statically attracted to the paper discharge guide roller 30, the paper sheet P cannot be transferred from the guide roller 30 to the transfer guide 25, resulting in jamming.

Figure 10:
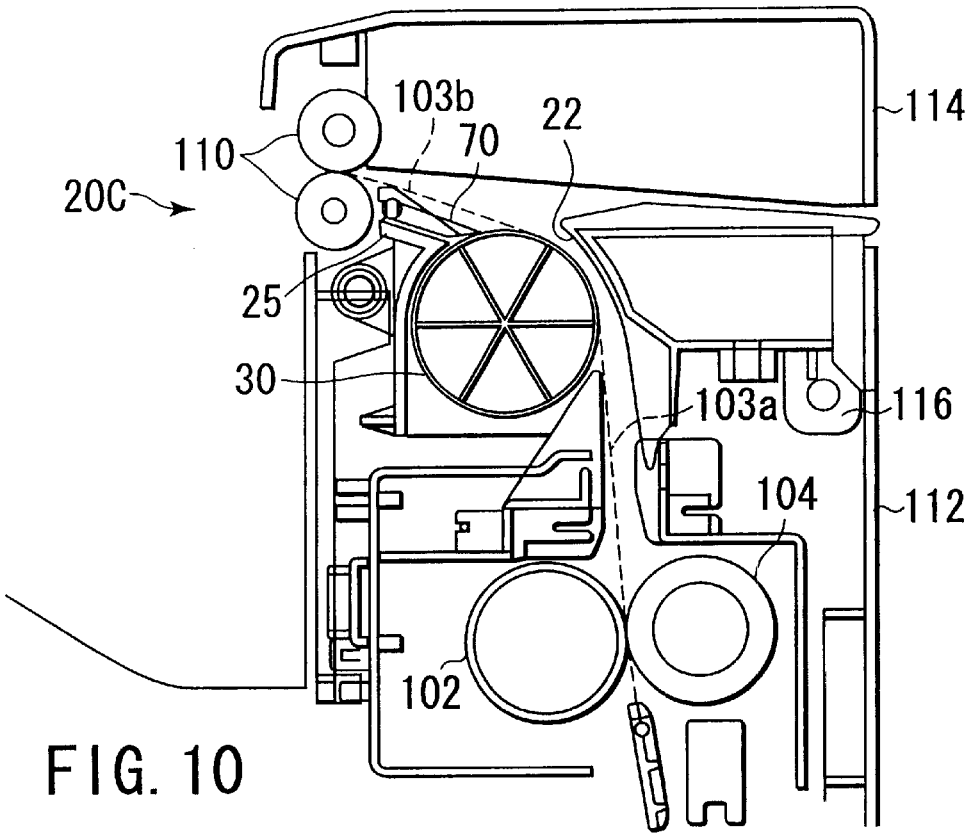
FIG. 10 is a cross-sectional view showing a peeling claw mechanism for peeling a paper sheet from the paper discharge guide roller of an image forming apparatus according to a fourth embodiment of the present invention.

Accordingly, in a fixing device 20C of the fourth embodiment, as shown in FIG. 10, a peeling claw mechanism 70 is mounted on a second transfer guide 25 to forcibly remove the leading end of the paper sheet P by means of the peeling claw mechanism 70, so that the paper sheet P can be easily transferred from the guide roller 30 to the transfer guide 25.

It is only necessary that the peeling claw mechanism 70 be located between the paper discharge guide roller 30 and the paper discharge driving rollers 110. Therefore, the member for supporting the peeling claw mechanism 70 is not limited to the second transfer guide 25 but may be the frame 112.

Figure 11:
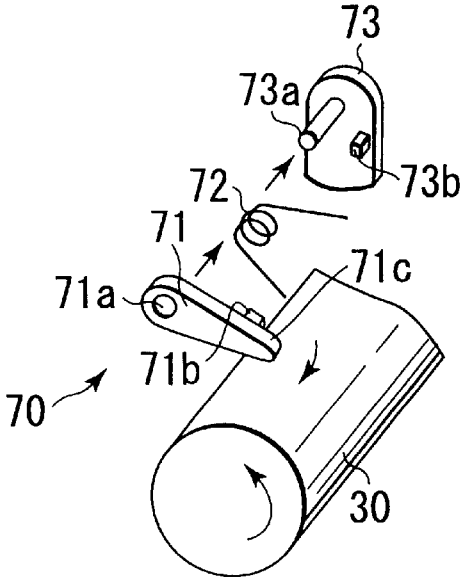
FIG. 11 is an exploded perspective view showing details of the peeling claw mechanism of the fourth embodiment.

As shown in FIG. 11, the peeling claw mechanism 70 comprises a claw 71, a torsion spring 72 and a post 73. The claw 71 is supported by the post 73. The post 73 is fixed by a stationary member, such as the frame 112. A hole 71*a* is formed in a proximal end side of the claw 71. The tip of a horizontal rod 73*a* of the support is inserted in the hole 71*a*. The torsion spring 72 is attached to the horizontal rod 73*a*.

One end of the torsion spring 72 is motion-restricted by a stopper 73*b* of the support, and the other end of the torsion spring 72 is motion-restricted by a stopper 71*b* of the claw. Therefore, the claw 71 is urged by the torsion spring 72, so that the tip of the claw 71 is pressed against the circumferential surface of the paper discharge guide roller 30 with suitable force. The claw 71 is provided such that it is pressed against the circumferential surface of the roller 30 in a direction opposite to the direction of the rotation of the paper discharge guide roller 30 and along a tangent line of the circumferential surface of the roller 30.

Figure 12:
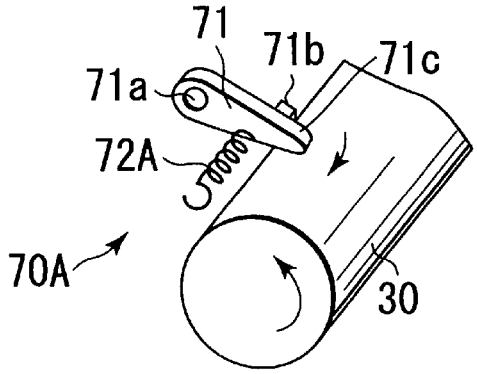
FIG. 12 is an exploded perspective view showing another peeling claw mechanism.

As shown in FIG. 12, another peeling claw mechanism 70A may be mounted on the transfer guide 25. The peeling claw mechanism 70A comprises a tension spring 72A instead of the torsion spring 72. One end side of the tension spring 72A is attached to a suitable position of the claw 71, and the other end side of the tension spring 72A is attached to a stationary fixed member other than the post 73.

According to this embodiment, the paper sheet P is reliably peeled from the guide roller 30 by the peeling claw mechanism 70 or 70A. Therefore, the occurrence of jamming is considerably reduced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a vertical transfer path through which a paper sheet having a toner image is transferred upward from below;

a horizontal transfer path which is continuous to the vertical transfer path and through which the paper sheet is transferred in a substantially horizontal direction;

a fixing roller which is brought into contact with one surface of the paper sheet on the vertical transfer path and which heats and melts toner of the toner image;

a pressurizing roller which is opposite to the fixing roller and which is brought into contact with another surface of the paper sheet on the vertical transfer path and pressurizes the toner image in association with the fixing roller;

a paper discharge driving roller which is provided at an end of the horizontal transfer path and which substantially horizontally discharges the paper sheet with the toner image fixed thereon;

a tray which receives the paper sheet discharged from the paper sheet discharge roller;

a paper transfer guide which is provided between the fixing roller and the paper discharge driving roller and which guides the paper sheet to be transferred along the vertical transfer path and the horizontal transfer path; and a paper discharge guide roller which is provided at a position between the vertical transfer path and the horizontal transfer path, which is rotatably supported by the paper transfer guide at a position where a transfer direction of the paper sheet is changed from vertical to horizontal, and which rotates following motion of the paper sheet to be transferred, which is made of a high-conductivity material and which has a structure of a good heat radiating characteristic.

2. An image forming apparatus according to claim 1, wherein the paper discharge guide roller is covered with an antistatic resin film on its circumferential surface.

3. An image forming apparatus according to claim 1, wherein the paper discharge guide roller is covered with a fluorinated ethylene resin-based film on its circumferential surface.

4. An image forming apparatus according to claim 1, wherein the paper discharge guide roller comprises a metal cylinder having a hollow portion extending therethrough in an axial direction and has a plurality of inner ribs in the hollow portion.

5. An image forming apparatus according to claim 4, wherein the inner ribs are straight blades parallel to an axis of the paper discharge guide roller.

6. An image forming apparatus according to claim 4, wherein the inner ribs are spiral blades or screw blades unparallel to an axis of the paper discharge guide roller.

7. An image forming apparatus according to claim 6, wherein the spiral blades or the screw blades are inclined 10° to 45° with respect to the axis of the paper discharge guide roller.

8. An image forming apparatus according to claim 1, wherein the paper discharge guide roller comprises a metal cylinder having a hollow portion extending therethrough in an axial direction and has an electric fan for exhausting the hollow portion of the paper discharge guide roller.

9. An image forming apparatus according to claim 1, further comprising:

an upper cover which is freely opened and closed to allow inspection of the paper discharge guide roller, the paper discharge driving roller, the paper transfer guide, the vertical transfer path and the horizontal transfer path, and which covers from above the paper discharge guide roller, the paper discharge driving roller, the paper transfer guide, the vertical transfer path and the horizontal transfer path when it is closed;

a protective cover which is provided in non-contact with the paper discharge guide roller and made of material of a low-thermal-conductivity and which covers a circumferential surface of the paper discharge guide rolller facing the horizontal transfer path, when the upper cover is opened; and a link mechanism which links to the protective cover and the upper cover such that the protective cover interlocks with the upper cover.

10. An image forming apparatus according to claim 9, wherein the link mechanism has an arm one end side of which rotatably links with the upper cover and another end side of which rotatably links with the protective cover.

11. An image forming apparatus according to claim 1, further comprising a peeling claw mechanism to peel the paper sheet from the paper discharge guide roller.

12. An image forming apparatus according to claim 11, wherein the peeling claw mechanism comprises:

a claw provided along a tangent line of a circumferential surface of the paper discharge guide roller;

a post which supports the claw; and a spring which is interposed between the post and the claw and pressed against the circumferential surface of the paper discharge guide roller in a direction opposite to a direction of a rotation of the paper discharge guide roller.

13. An image forming apparatus comprising:

a vertical transfer path through which a paper sheet having a toner image is transferred upward from below;

a horizontal transfer path which is continuous to the vertical transfer path and through which the paper sheet is transferred in a substantially horizontal direction;

a fixing roller which is brought into contact with one surface of the paper sheet on the vertical transfer path and which heats and melts toner of the toner image;

a pressurizing roller which is opposite to the fixing roller and which is brought into contact with another surface of the paper sheet on the vertical transfer path and pressurizes the toner image in association with the fixing roller;

a paper discharge driving roller which is provided at an end of the horizontal transfer path and which substantially horizontally discharges the paper sheet with the toner image fixed thereon;

a tray which receives the paper sheet discharged from the paper sheet discharge roller;

a paper transfer guide which is provided between the fixing roller and the paper discharge driving roller and which guides the paper sheet to be transferred along the vertical transfer path and the horizontal transfer path; and a paper discharge guide roller which is provided at a position between the vertical transfer path and the horizontal transfer path where a transfer direction of the paper sheet is changed from vertical to horizontal, and which rotates following motion of the paper sheet to be transferred, which is made of a high-conductivity material and which has a structure of a good heat radiating characteristic, and wherein the paper discharge guide roller is covered with one of an antistatic resin film and a fluorinated ethylene resin-based film on its circumferential surface.

14. An image forming apparatus comprising:

a vertical transfer path through which a paper sheet having a toner image is transferred upward from below;

a horizontal transfer path which is continuous to the vertical transfer path and through which the paper sheet is transferred in a substantially horizontal direction;

a fixing roller which is brought into contact with one surface of the paper sheet on the vertical transfer path and which heats and melts toner of the toner image;

a pressurizing roller which is opposite to the fixing roller and which is brought into contact with another surface of the paper sheet on the vertical transfer path and pressurizes the toner image in association with the fixing roller;

a paper discharge driving roller which is provided at an end of the horizontal transfer path and which substantially horizontally discharges the paper sheet with the toner image fixed thereon;

a tray which receives the paper sheet discharged from the paper sheet discharge roller;

a paper transfer guide which is provided between the fixing roller and the paper discharge driving roller and which guides the paper sheet to be transferred along the vertical transfer path and the horizontal transfer path; and a paper discharge guide roller which is provided at a position between the vertical transfer path and the horizontal transfer path where a transfer direction of the paper sheet is changed from vertical to horizontal, and which rotates following motion of the paper sheet to be transferred, which is made of a high-conductivity material and which has a structure of a good heat radiating characteristic, wherein the paper discharge guide roller comprises a metal cylinder having a hollow portion extending therethrough in an axial direction and has a plurality of inner ribs in the hollow portion, wherein the inner ribs are one of spiral blades and screw blades unparallel to an axis of the paper discharge guide roller.

15. An image forming apparatus according to claim 14, wherein the one of spiral blades and screw blades are inclined 10° to 45° with respect to the axis of the paper discharge guide roller.

* * * * *